US006406275B1

(12) United States Patent
Hoehn

(10) Patent No.: US 6,406,275 B1
(45) Date of Patent: Jun. 18, 2002

(54) CUT FOR SERVICE MOTOR WITH SERVICE RING

(75) Inventor: Garrett Wade Hoehn, Kenmore, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/669,070

(22) Filed: Sep. 22, 2000

(51) Int. Cl.[7] ..... F04B 17/00
(52) U.S. Cl. ..... 417/366
(58) Field of Search ..... 417/366, 367, 417/357, 321; 62/505, 367, 368, 369, 370, 371

(56) References Cited

U.S. PATENT DOCUMENTS 4,227,902 A * 10/1980 Olson ..... 55/302
4,272,931 A * 6/1981 Stanizzo ..... 52/98
4,547,135 A * 10/1985 Noel et al. ..... 417/360
4,727,826 A * 3/1988 Draper et al. ..... 122/379
4,836,753 A * 6/1989 Berfield et al. ..... 417/236
4,913,189 A * 4/1990 Kline et al. ..... 137/560
5,007,806 A * 4/1991 Bellis et al. ..... 417/360
5,069,041 A * 12/1991 Thielman et al. ..... 62/263
5,224,844 A * 7/1993 Lopez ..... 417/423.1
5,538,406 A * 7/1996 Siegal et al. ..... 417/360
5,569,023 A * 10/1996 Ishida et al. ..... 417/326
5,660,605 A * 8/1997 Chan et al. ..... 55/274
5,714,814 A * 2/1998 Marioni ..... 310/87
5,911,563 A * 6/1999 Duppert et al. ..... 417/360
5,955,803 A * 9/1999 Gandhi et al. ..... 310/52
6,045,340 A * 4/2000 Batchelder et al. ..... 417/360
6,123,503 A * 9/2000 Belanger et al. ..... 415/127

* cited by examiner

*Primary Examiner*—Teresa Walberg
*Assistant Examiner*—Daniel Robinson
(74) *Attorney, Agent, or Firm*—Kathryn A. Marra

(57) ABSTRACT

A casing assembly for a blower motor of a heating, venting, and air conditioning system of a motor vehicle includes a fan chamber for housing a blower fan and a motor chamber for housing the blower motor. An air conduit molded integrally with the assembly channels air from the fan chamber to the motor chamber for cooling the motor. A panel connects the fan chamber to the motor chamber. The panel includes a groove circumscribing the motor chamber for pierceable separating the motor chamber from the assembly to service the motor and the fan. The assembly further includes a band for reconnecting the separated motor chamber to the assembly after servicing the motor.

19 Claims, 5 Drawing Sheets

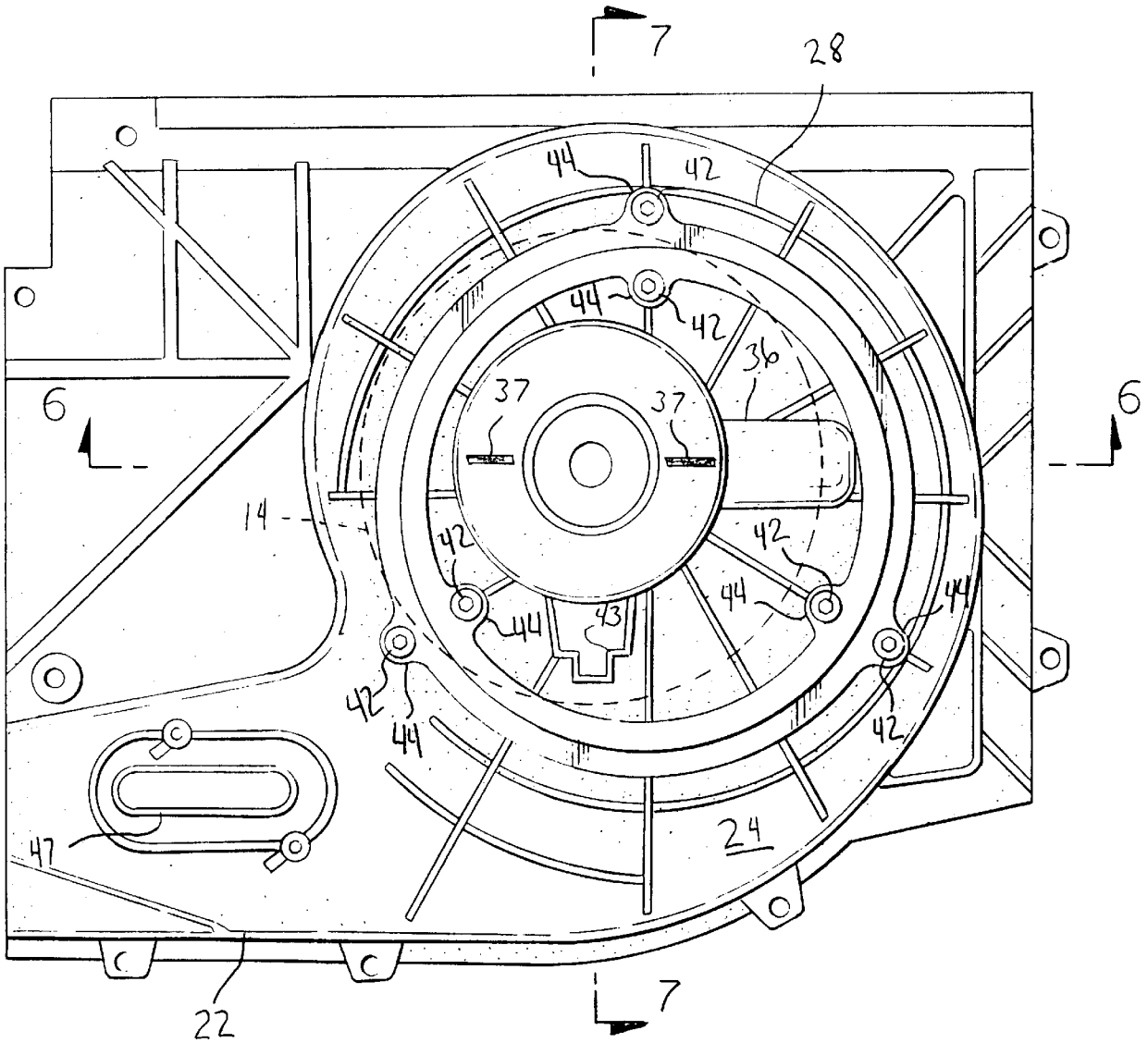
6
28
7
42
44
42
44
42
44

CUT FOR SERVICE MOTOR WITH SERVICE RING

TECHNICAL FIELD

The subject invention relates generally to an improved casing assembly for a blower motor of a heating, venting, and air conditioning system for a motor vehicle. More specifically, the subject invention relates to an improved serviceability for a blower motor fully enclosed by the casing assembly.

BACKGROUND OF THE INVENTION

A blower motor for a motor vehicle heating, venting, and air conditioning system (HVAC) includes a fan driveably affixed thereto. The blower motor is generally positioned inside the passenger compartment of the motor vehicle under the instrument panel. A blower casing assembly conceals the fan and channels air accelerated by the fan to the HVAC ducts, which route the air to various vents disposed about the passenger compartment. Generally, the casing encloses only the fan and not the motor. This exposes the motor to environmental contaminants generated by passengers, such as, for example, moisture, dirt, and physical contact.

A further deficiency of a casing covering only the fan is the inability of the casing to channel air from the fan to the motor for cooling the motor. This requires additional components such as hoses and supplemental casing to route cooling air from the fan to the motor. Casings have been designed that enclose both the motor and the fan, which overcome some of the deficiencies discussed herewith. However, a unitary casing of this design generates additional complications. For example, the unitary casing can inhibit access when attempting to perform service on the motor.

The blower motor can require service for such defects as generating excessive noise, not operating, or being jammed from debris entangled with the fan. Accessing a motor concealed within a unitary housing requires removal of the full casing, which is time consuming and costly. Frequently, the casing can be damaged during removal or reinstallation requiring replacement of the entire casing.

Therefore, a need exists for a blower motor casing that derives the benefits of a unitary design that encloses both the motor and the fan and also provides serviceable access to the motor and the fan.

SUMMARY OF THE INVENTION

A casing assembly for a blower motor of a heating, venting, and air conditioning system of a motor vehicle includes a fan chamber for housing a blower fan and a motor chamber for housing the blower motor. An air conduit channels air from the fan chamber to the motor chamber. A panel connects the fan chamber to the motor chamber. The panel includes a groove circumscribing the motor chamber for separating the motor chamber from the assembly. The groove can be pierced for cutting a ring around the motor chamber for removing the motor and the fan for service. The assembly includes a band for reconnecting the separated motor chamber to the assembly.

The casing assembly of the subject invention resolves the deficiencies of the prior art by providing a unitary design with serviceable features. The unitary design of the subject invention encloses both the fan and the motor protecting the motor from environmental contaminants. Further, an air conduit can be molded integrally with the casing eliminating the need for supplemental casing and a hose for routing cooling air to the motor from the fan. This concept provides cost and mass reduction to the (HVAC) system.

Piercing the groove provides a method of accessing the motor and the fan for service in a time and cost efficient manner by eliminating the need for removing the entire casing. Further, providing a band for reconnecting the motor chamber to the assembly provides for the reuse of the motor chamber after the motor has been serviced or replaced. This reduces the service cost in two ways. By reusing the motor chamber eliminates the need for purchasing a new casing assembly after servicing. Further shipping and storage costs for the band are much lower than for a replacement casing assembly due to the band's substantially two dimensional geometry as opposed to the casing's three dimensional geometry

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is a top view of the subject invention; and

DESCRIPTION OF THE PREFERRED EMBODIMENT

Figure 1:
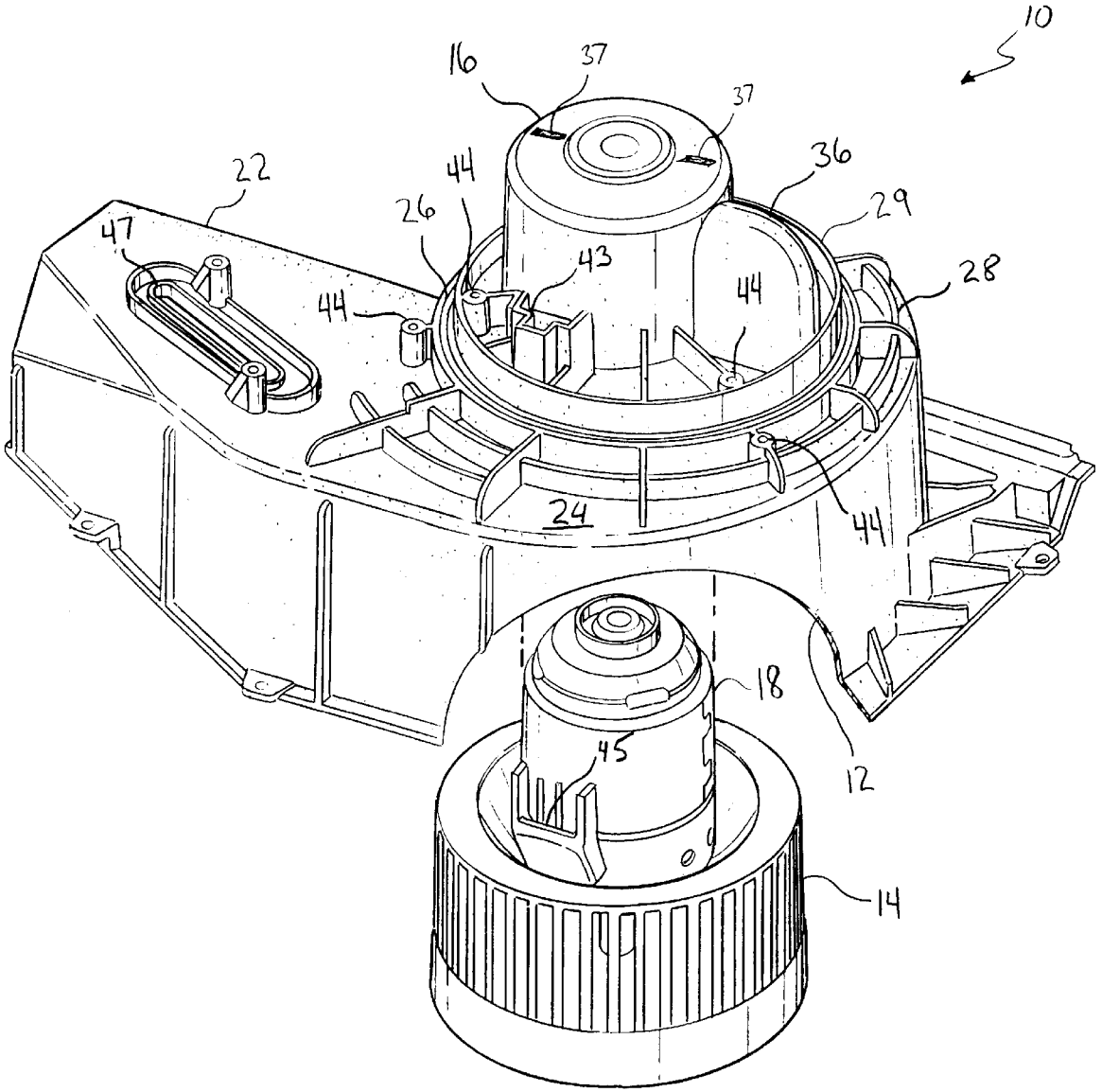
FIG. 1 is an exploded view of the subject invention.

Referring to FIG. 1, a casing assembly for a blower motor of a heating, venting, and air conditioning system (HVAC) of a motor vehicle is generally shown at 10. The assembly 10 includes a fan chamber 12 for housing a blower fan 14 and a motor chamber 16 for housing the blower motor 18. The fan 14 is driveably attached to the motor 18 via a drive shaft 20. The blower motor 18 is activated to circulate air throughout the passenger compartment of the motor vehicle via HVAC air ducts (not shown). An air channel 22 funnels air accelerated by the fan 14 from the assembly 10 to the HVAC ducts.

A panel 24 connects the fan chamber 12 to the motor chamber 16. The panel 24 includes a groove 26 that circumscribes the motor chamber 16 for separating the motor chamber 16 from the assembly 10 as will be explained further hereinbelow. The panel 24 further includes webbing 28 for strengthening the assembly 10.

Figure 2:
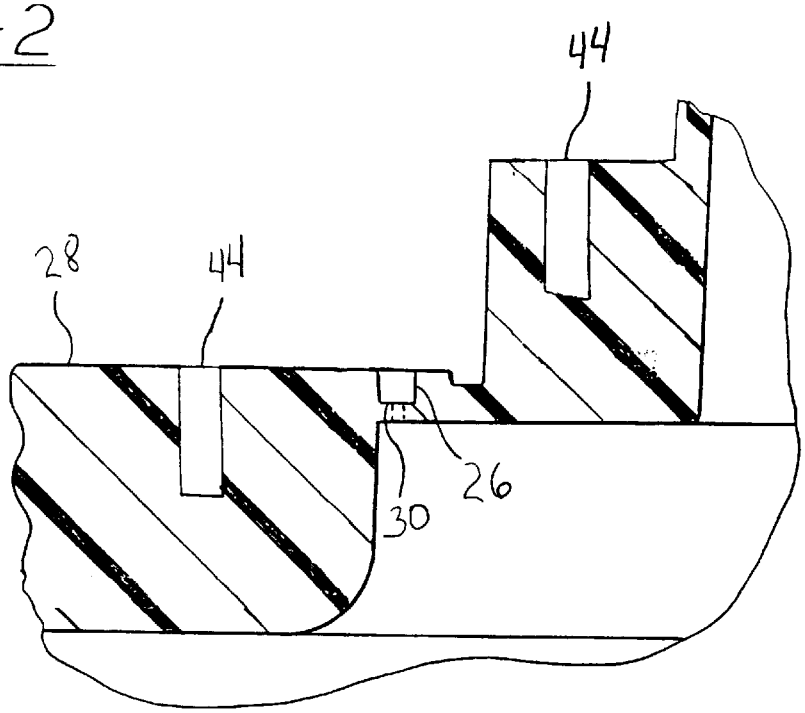
FIG. 2 is a side sectional view of the groove of the subject invention.

As best shown in FIG. 2, the groove 26 includes a base 30, which is pierceable for separating the motor chamber 16 from the assembly 10. During a service procedure, the base 30 can be pierced with a razor or equivalently sharp instrument for cutting a ring 32 into the groove 26 circumscribing the motor chamber 16. In the preferred embodiment, the base 30 is molded from the same materials as the assembly 10, however, it is understood by the inventor that the base 30 could be molded from a more pliant material that would be more easily pierced. The more pliant base 30 is affixed to the assembly 10 by insertion into a mold tool prior to injecting the assembly 10 material. The assembly 10 material of the subject invention is contemplated to be a talc or glass filled polypropylene, or an equivalent.

As best represented in FIG. 5, the groove 26 is oriented in a non-symmetrical spatial relationship with the motor chamber 16. Therefore, the ring 32 is cut into the base 30 in an offset spatial relationship to the motor chamber 16. The intent of the offset is to reduce the possibility of damaging the fan 14 with the piercing tool. Due to the offset the groove 26 the ring 32. The intersects the fan 14 only twice, as opposed to tracing the fan 14, for reducing the probability of contact between the fan 14 and the piercing tool.

Pursuant to cutting the ring 32 into the assembly 10, the motor chamber 16 can be extracted from the casing assembly 10. Because the fan 14 is offset from the ring 32, the fan 14 and the ring 32 must be oriented for extracting the fan 14 and the motor 18. Once oriented, the fan easily slide out of the assembly 10 through an opening 34 formed by the ring 32.

Figure 3:
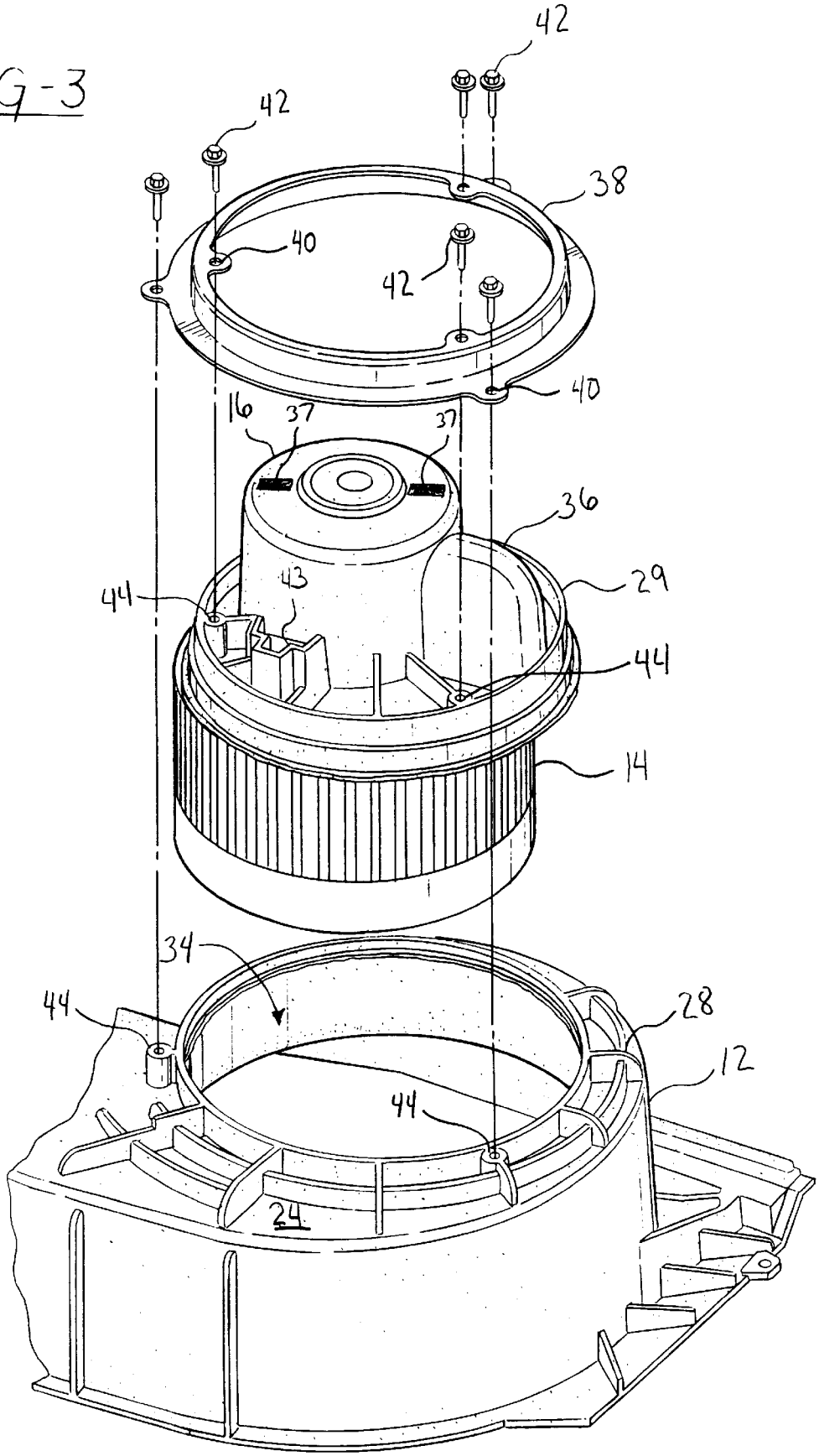
FIG. 3 is an exploded view of the subject invention showing the motor housing separated from the fan housing.

As seen in FIGS. 1 and 3, an air conduit 36 is molded integrally with the assembly 10 for cooling the motor. The conduit 36 connects the fan chamber 12 to the motor chamber 16 for channeling cooling air from the fan chamber 12 to the motor chamber 16. The motor chamber 16 includes at least one vent 37 for venting cooling air out of the motor chamber 16. Molding the conduit 36 integrally with the assembly 10 eliminates the need for adding a cooling tube to the assembly 10 as is currently practiced.

Figure 6:
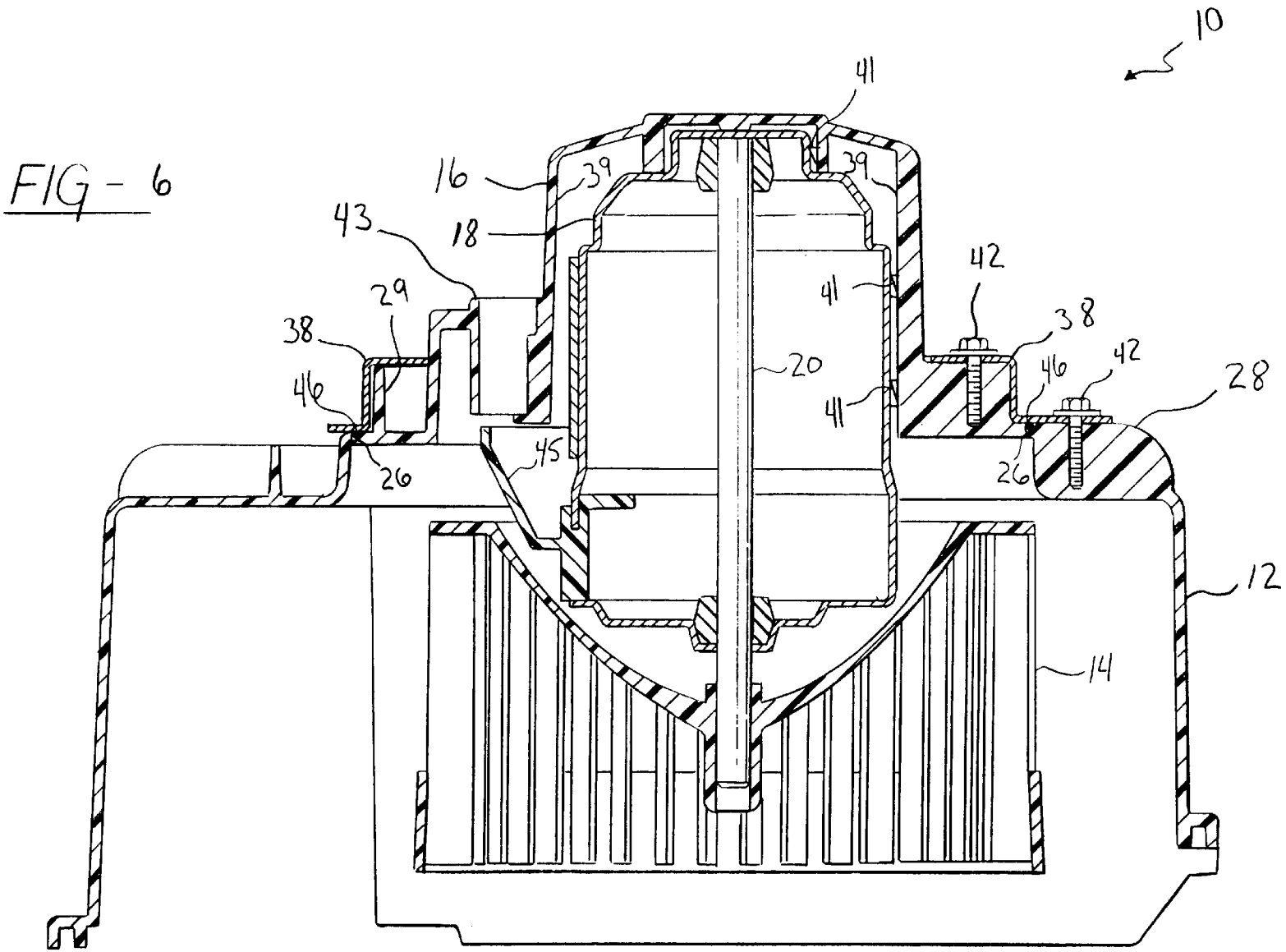
FIG. 6 is a sectional view of the subject invention through line 6—6 of FIG. 5.

The motor chamber 16 includes an inner surface 39. The inner surface 39 includes at least one catch 41 for securing the motor 18 within motor chamber 16. The sectional view in FIG. 6 shows the catch 41 formed as a series of ramps decreasing the volume within the motor chamber 16 for creating a press fit condition between the motor chamber 16 and the motor 18. The press fit condition secures the motor 18 within the chamber and still allows the motor to be easily removed from the motor chamber 16 for service or replacement.

The motor chamber 16 includes an electrical inlet 43 for providing electrical access to the motor. As shown in FIG. 1, the motor includes an electrical connector 45 aligning with the electrical inlet 43. In installed position, an electrical wire harness (not shown) includes an appendage having an electrical connector disposed at the end thereof that plugs into the electrical inlet 43. The same appendage can include a second electrical connector for connecting to a blower motor 18 speed control (not shown) attached to the assembly 10 in a slot 47 located in the air channel 22.

Figure 4:
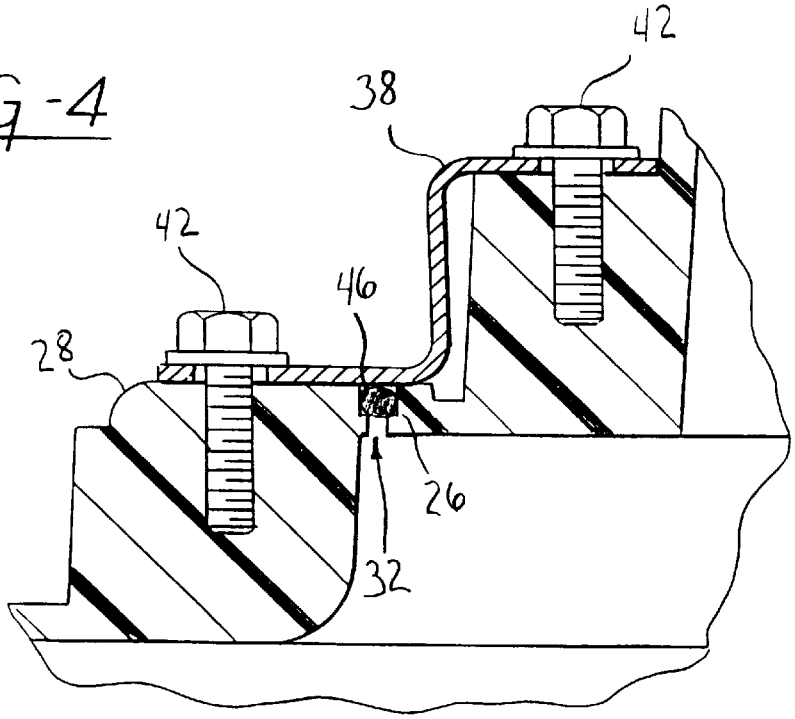
FIG. 4 is a sectional view of the subject invention showing the band reconnecting the motor housing to the fan housing.

Referring to FIGS. 3 and 4, the assembly 10 includes a band 38 for reconnecting the extracted motor chamber 16 to the assembly 10. Subsequent to repairing or replacing the motor 18, the motor 18 is re-inserted into the motor chamber 16. The extracted motor chamber 16 having the repaired blower motor 18 secured therein is re-aligned with the ring 32 cut into the casing assembly 10. The webbing 28 includes an alignment wall 29 for aligning the band 38 with the groove 26, and for aligning the band 38 over the ring 32 to secure the extracted motor chamber 16 to the casing assembly 10. The band 38, in the preferred embodiment, is formed from steel or an equivalently rigid material for supporting the reconnected motor chamber 16 and the assembly 10.

The band 38 includes a plurality of apertures 40 for receiving fasteners 42. The assembly 10 includes a plurality of bosses 44 aligning with the apertures 40 for securing the band 38 to the assembly 10 with the fasteners 42. The bosses 44 are arranged concentrically on each side of the groove 26. A first concentric arrangement of bosses 44 is disposed upon the assembly 10. A second concentric arrangement of bosses 44 is disposed upon the extracted motor chamber 16. Therefore, the band 38, having received the fasteners 42, re-attaches the extracted motor chamber 16 to the assembly 10.

Prior to affixing the band 38 to the assembly 10, the ring 32 is sealed for preventing air from escaping from the casing assembly 10 and for preventing moisture from entering the casing assembly 10. The seal 46 of the preferred embodiment as shown in the FIGS. 4 through 7 is a viscous sealing material extruded into the groove 26, prior to aligning the band 38 over the ring 32. It is, however, understood that a flexible, solid seal 46 could be affixed to the band 38 for sealing the entire groove 26, and therefore, preventing the air or moisture from passing through the ring 32.

The invention has been described in an illustrative manner, and it is to be understood that the terminology which has been used is intended to be in the nature of words of description rather than of limitation.

Many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A casing assembly for a blower motor of a heating, venting, and air conditioning system of a motor vehicle comprises:

a motor chamber for housing the blower motor;

a fan chamber for housing a blower fan;

an air conduit molded integrally with said assembly channeling air from said fan chamber to said motor chamber for cooling the motor;

a panel connecting said fan chamber to said motor chamber; and said panel including a groove, whereby said groove circumscribes said motor chamber and is pierceable for separating said motor chamber from said assembly.

2. An assembly as set forth in claim 1, wherein said groove circumscribes said motor chamber forming a ring around said motor chamber, said ring being non-symmetrical with said motor chamber.

3. An assembly as set forth in claim 2, wherein said groove includes a base, said base being piercable for separating said motor chamber from said assembly.

4. An assembly as set forth in claim 3, wherein said motor chamber includes at least one vent for venting cooling air out of said motor chamber.

5. An assembly as set forth in claim 4, said assembly further including a band for reconnecting said separated motor chamber to said assembly.

6. An assembly as set forth in claim 5, wherein said band includes a plurality of apertures for receiving a plurality of fasteners.

7. An assembly as set forth in claim 6, wherein said assembly includes a plurality of bosses aligning with said apertures for securing said ring to said assembly with said fasteners.

8. An assembly as set forth in claim 7, wherein said bosses are arranged concentrically on each side of said groove.

9. An assembly as set forth in claim 8, wherein said motor chamber includes an inner surface, said inner surface including at least one catch for securing the motor within said motor chamber.

10. An assembly as set forth in claim 9, wherein said motor chamber includes an electrical inlet for providing electrical access to the motor.

11. An assembly as set forth in claim 10, wherein said panel includes webbing for strengthening said assembly.

12. An assembly as set forth in claim 11, wherein said webbing includes an alignment wall for aligning said band with said groove.

13. A method for repairing a blower motor having a fan driveably affixed thereto, said blower motor being housed within a motor chamber of a casing assembly of a vehicle heating, venting, and air conditioning system; said method comprising:

cutting a ring into said casing assembly circumscribing said motor chamber;

simultaneously extracting said motor chamber and the blower motor from said casing assembly;

repairing the blower motor;

realigning said extracted motor chamber having the repaired blower motor affixed therein with said ring cut in said casing assembly; and securing said extracted motor chamber to said casing assembly.

14. A method as set forth in claim 13, wherein said step of cutting a ring into said casing is further defined by cutting a ring in a non-symmetrical spatial relationship to said motor chamber.

15. A method as set forth in claim 14, wherein said step of extracting said motor chamber from said casing assembly is further defined by orienting the fan with the non-symmetrical ring for extracting the motor from said casing assembly.

16. A method a set forth in claim 15, wherein said step of repairing the motor includes replacing the motor.

17. A method as set forth in claim 16, wherein said step of securing said extracted motor chamber to said casing assembly is further defined by aligning a band over said ring.

18. A method as set forth in claim 17, further including the step of fasting said band to said motor chamber and to said casing assembly.

19. A method as set forth in claim 18, further including the step of sealing said ring for preventing air from escaping from said casing assembly and for preventing moisture from entering said casing assembly.

* * * * *